United States Patent [19]

Diaz

[11] Patent Number: 4,987,817

[45] Date of Patent: Jan. 29, 1991

[54] MUSICAL CYMBAL SUPPORT AND REVOLVER ACCESSORIES

[76] Inventor: Gilberto B. Diaz, P.O. Box 3287, Taos, N. Mex. 87571

[21] Appl. No.: 383,450

[22] Filed: Jul. 24, 1989

[51] Int. Cl.[5] ..... G10D 13/02

[52] U.S. Cl. ..... 84/421

[58] Field of Search ..... 84/421

[56] References Cited

U.S. PATENT DOCUMENTS

| | | | |
|---|---|---|---|
| 2,844,064 | 7/1958 | Bendett | 84/421 |
| 3,561,716 | 2/1971 | Thompson | 84/421 X |
| 4,047,684 | 9/1977 | Kobayashi | 84/421 X |
| 4,200,024 | 4/1980 | Watson | 84/421 |
| 4,889,028 | 12/1989 | Lombardi | 84/421 |

OTHER PUBLICATIONS

Music Emporium (Spring–Summer 1989) Catalog; pp. D10, D12, D14, D15, D16, D20, D23, D26, D27 and D28.

*Primary Examiner*—Brian W. Brown

[57] ABSTRACT

Accessory items for mounting a percussion instrument (a musical cymbal) relating generally to instrument's hardware and their accessories which are now being adapted through a variety of itemized supports are disclosed herein to include adjustable and/or non-adjustable cymbal support means mounted to (optional) resilient protected adjustable and/or non-adjustable rotatable means journaled to support means which are coupled to hardware fastening means or comprising complete standards extently providing different devices (apparatus) of varying shapes and forms with multiple adjustments to permit cymbal to revolve (after impact) about an axis which may and may not be lying generally parallel to and spaced from a plane defined by the marginal periphery of the cymbal thus to impart a revolution which give viewers (audience) stupendous complex rhythmical sounds along with flashing exiting visual effects of truly unlimited epic proportions.

8 Claims, 4 Drawing Sheets

MUSICAL CYMBAL SUPPORT AND REVOLVER ACCESSORIES

FIELD OF INVENTION

The present invention relates generally to percussion instruments' hardware such as cymbal stands, mounting arms, holders, clamps, springs, extenders, and accessories which are now being used and adapted through a variety of itemized supports and brackets, and more particularly to novel support holder and revolver accessories for mounting a cymbal so that it creates a unique musical sound along with presenting diversified and animated revolving appearances after impact.

BRIEF DESCRIPTION OF THE PRIOR ART

Conventionally, the drum industry is stagnant relative to producing advanced changes/innovations from traditional cymbal stands and limited themselves to accessory items which perform the same function. U.S. Pat. No. 4,200,024, dated Apr. 29, 1980, Title: "Apparatus For Mounting a Percussion Instrument," provides a valuable innovation whereas it illustrates a standard and rotatable means mounted on said standard for supporting the cymbal and permitting it to revolve, after impact, about an axis lying generally parallel to a plane defined by the marginal periphery of the cymbal resulting in unique, intriguing musical phasing in addition to a flashing, and pleasing appearance by virtue of the cymbal's revolution. This invention is a bulky stand; not portable because the semicircle support feature cannot be folded or reduced in size like most cymbal stands for easy storing and transporting. The said support feature is inconvenient and not ultimately necessary for a revolving cymbal effect. The arm means has no safety factors because, upon impact, the instrument has a tendency to dance on the post which supports it and the cymbal can be damaged by impacting the arm means. It's time consuming—to determine the angle of repose because the cymbal has to be selectively positioned relative to the fixed post member so that the center of gravity of the arm means combines with the instrument and post member prior to impact. After impact, the apparatus and instrument revolves in only one limited direction plus its bulkness wouldn't permit multiple uses of it around a drum set. This prior art method is only slightly satisfactory and the need for more compact, more diversified and versatile methods remain.

SUMMARY OF THE INVENTION

Accordingly, the above problems and difficulties are obviated by the present invention which provides numerous accessory items relating to improvements in means for supporting and revolving plates of cymbals. The present invention comprises rotatable means of resilient protected adjustable/non-adjustable arm means consisting of an elongate member having an opposed offset end portion rotatably mounted to adjustable/non-adjustable support means coupled to fastening means/-brackets depending on usage. The opposing end of arm means comprises of adjustable/non- adjustable post member/cymbal support (holder) extending outwardly from the arm means to selectively position the instrument's angle of repose prior to impact. The diversification of the present invention presents multiple ways for the cymbal to revolve thereby providing extraordinary forms of observational entertainment along with novel accoustical effects of the sound reproduction therefrom.

The adjustable and non-adjustable facets provide many multiple uses about a drum set accentuating safetiness and freedom of movement for the instrument (having not to follow a revolution solely about an axis lying generally parallel to a plane defined by the marginal periphery of the cymbal). Thus, it's the primary object of the present invention to provide musical cymbal support and revolver accessory items which are safer, faster, easier, more versatile and compact comfortable for employment, storing and transporting emphasizing a higher marketability than its counterpart.

DETAILED DESCRIPTION OF THE INVENTION

Figure 1:
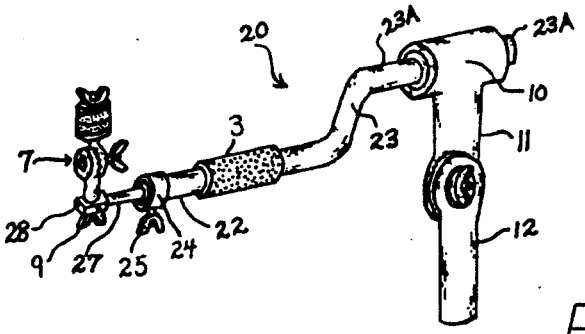
FIG. 1 is a perspective view of "Musical Cymbal Support and Revolver Accessories" in accordance with the present invention.
Figure 9:
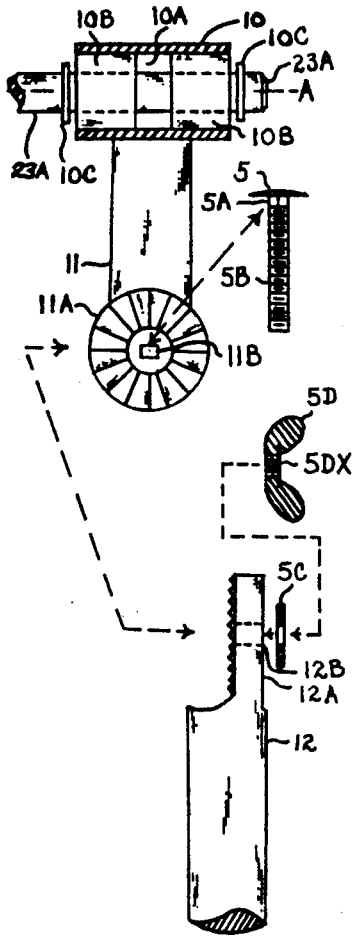
FIG. 9 is an exploded, sectional in part, elevational view of the support means member, the adjustable elbow and its tubular mounting arm members seen in FIG. 1.
Figure 2:
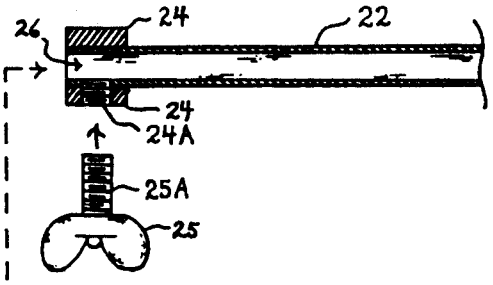
FIG. 2 is a horizontal sectional view of a portion of the elongate rotatable arm means member as seen FIG. 1.
Figure 3:
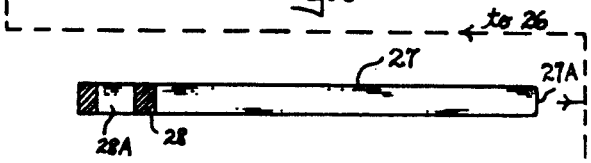
FIG. 3 is a partial horizontal sectional view of the elongate shaft member operable within and without arm means member seen in FIG. 2.
Figure 4:
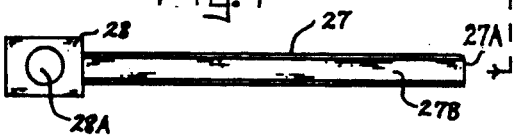
FIG. 4 is a bottom elevational view of the elongate shaft member seen in FIG. 3.
Figure 5:
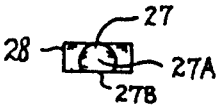
FIG. 5 is a rear elevational view of the elongate shaft member seen in FIGS. 3 and 4.
Figure 6:
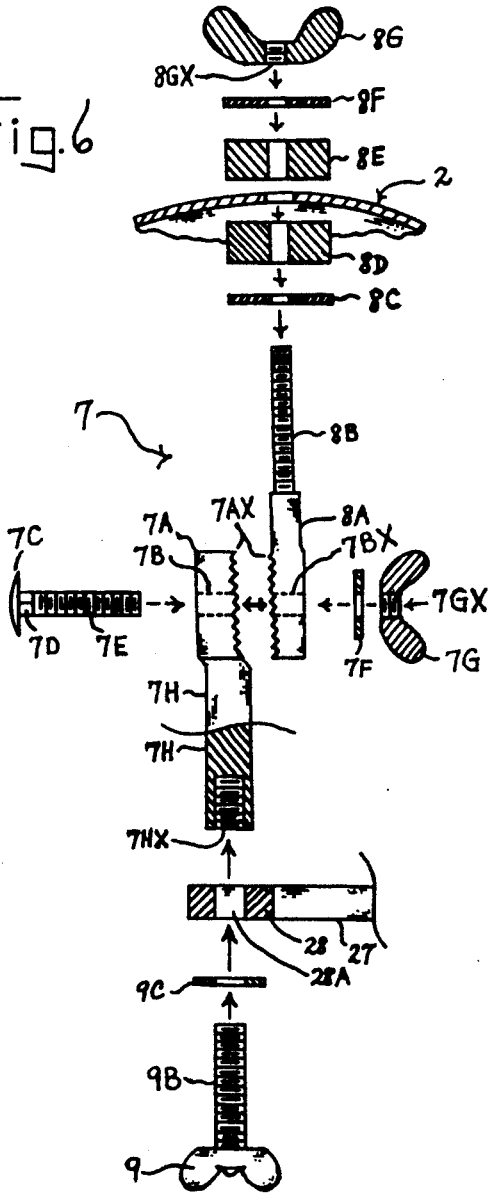
FIG. 6 is an exploded sectional in part, elevational view of the adjustable cymbal support elbow seen in FIG. 1.
Figure 10:
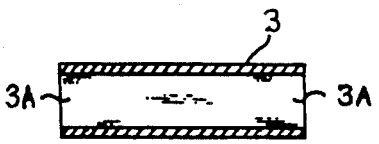
FIG. 10 is horizontal sectional view of the cymbal safety arm means sleeve seen in FIG. 1.
Figure 11:
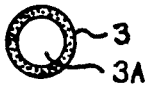
FIG. 11 is a front elevational view of the sleeve seen in FIG. 10.
Figure 12:
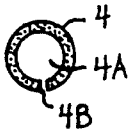
FIG. 12 is a front elevational view of a second embodiment of the cymbal safety arm means sleeve described and seen in FIGS. 10 and 11.
Figure 7:
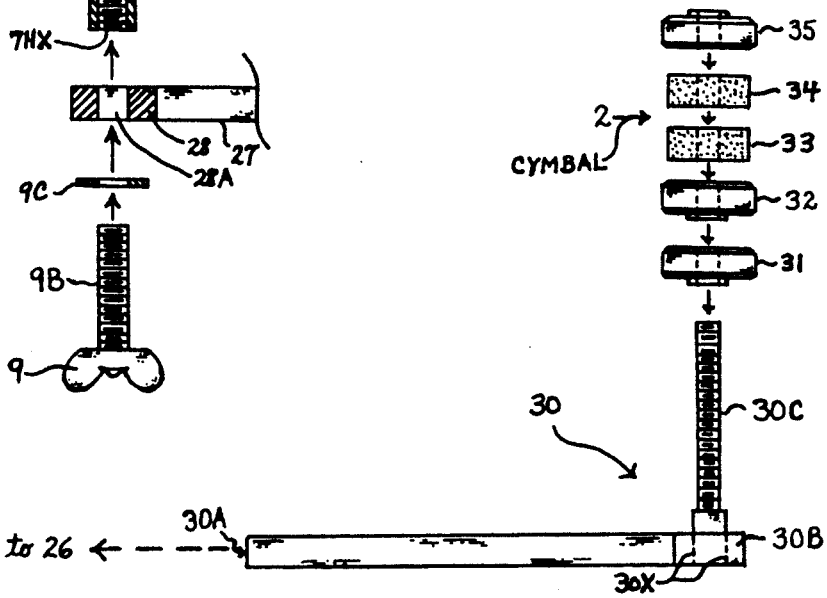
FIG. 7 is an exploded horizontal elevational view of a second embodiment of the elongate shaft member and of the adjustable cymbal support elbow described and seen in FIGS. 3,4,5 and 6 respectively thus concluding in a second embodiment of "Musical Cymbal Support and Revolver Accessories" seen in FIG. 1, in accordance with the present invention.
Figure 8:
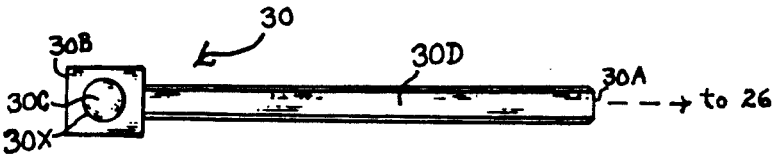
FIG. 8 is a bottom elevational view of the elongate shaft member seen in FIG. 7.
Figure 13:
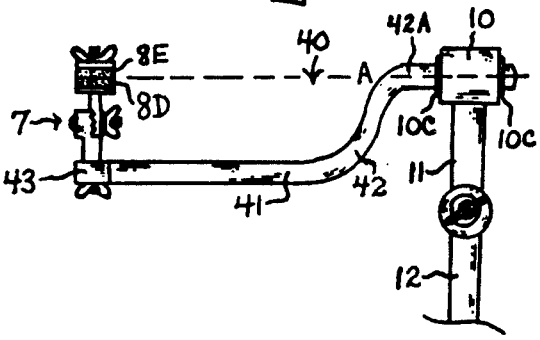
FIG. 13 is a side elevational view of a third embodiment of "Musical Cymbal Support and Revolver Accessories" seen in FIG. 1 in accordance with the present invention.
Figure 14:
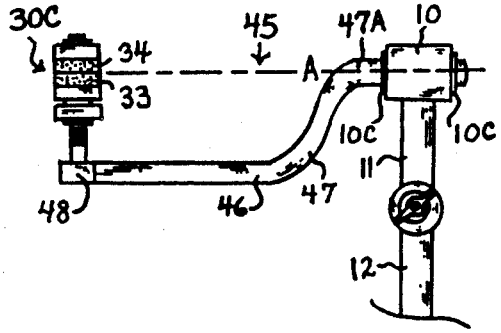
FIG. 14 is a side elevational view of a fourth embodiment of "Musical Cymbal Support and Revolver Accessories" seen in FIG. 1 in accordance with the present invention.
Figure 15:
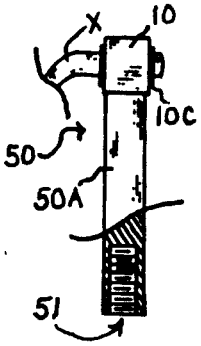
FIG. 15 is a partial side elevational and partial sectional view of a fifth embodiment of "Musical Cymbal Support and Revolver Accessories" seen in FIG. 1 in accordance with the present invention.
Figure 16:
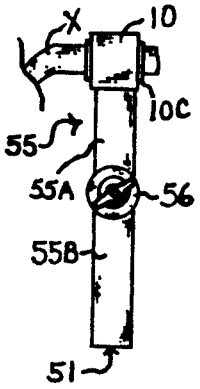
FIG. 16 is a partial side elevational view of a sixth embodiment of "Musical Cymbal Support and Revolver Accessories" seen in FIG. 1 in accordance with the present invention.
Figure 17:
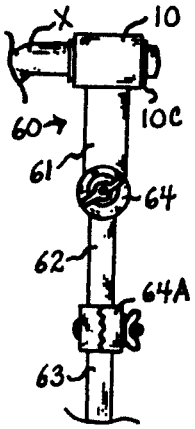
FIG. 17 is a partial side elevational view of a seventh embodiment of "Musical Cymbal Support and Revolver Accessories" seen in FIG. 1 in accordance with the present invention.
Figure 18:
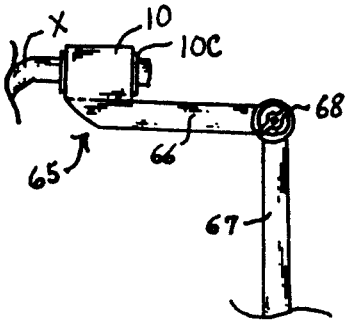
FIG. 18 is a partial side elevational view of an eighth embodiment of "Musical Cymbal Support and Revolver Accessories" seen in FIG. 1 in accordance with the present invention.
Figure 19:
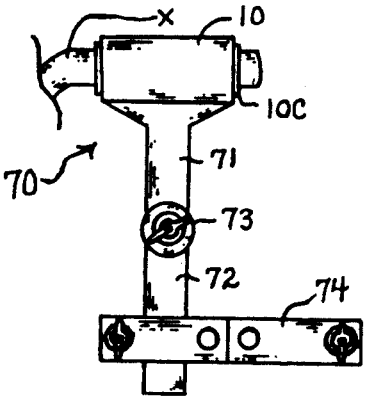
FIG. 19 is a partial side elevational view of a ninth embodiment of "Musical Cymbal Support and Revolver Accessories" seen in FIG. 1 in accordance with the present invention.
Figure 20:
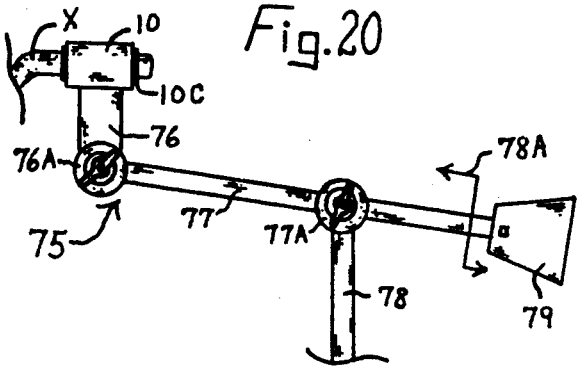
FIG. 20 is a partial side elevational view of a tenth embodiment of "Musical Cymbal Support and Revolver Accessories" seen in FIG. 1 in accordance with the present invention.
Figure 21:
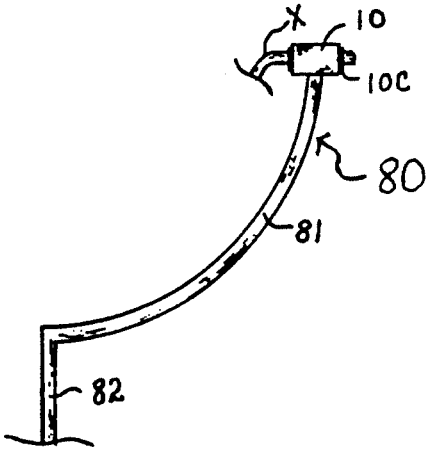
FIG. 21 is a partial side elevational view of an eleventh embodiment of "Musical Cymbal Support and Revolver Accessories" seen in FIG. 1 in accordance with the present invention.
Figure 22:
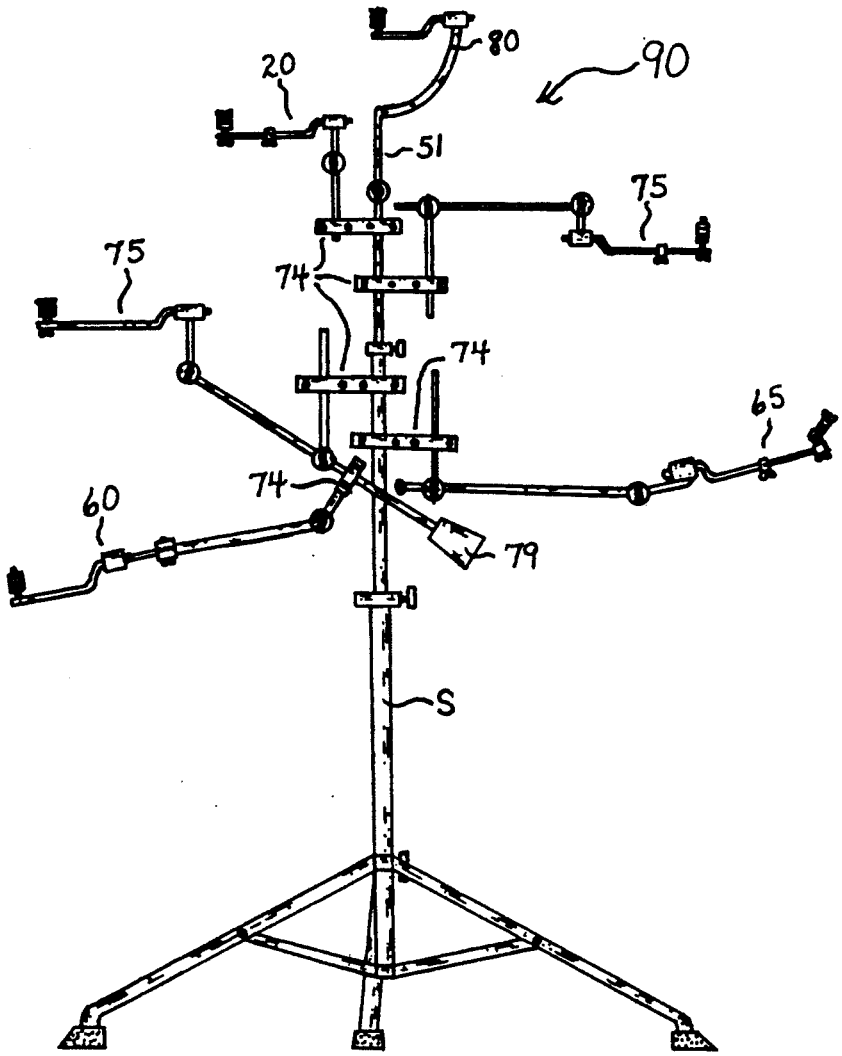
FIG. 22 is an elevational view of a general example of a musical cymbal tree, a twelfth embodiment employing a portion of the "Musical Cymbal Support and Revolver Accessories" described and seen in FIGS. 1 through 21 in accordance with the present invention.

The preferred embodiments of the present invention will be explained with reference to FIGS. 1 through 22. There is seen in FIGS. 1,7,8 and 13 through 22 twelve embodiments generally designated 20 (FIG. 1), 30 (FIGS. 7 and 8), and 40,45,50, 55,60,65,70,75,80,90 for FIGS. 13 through 22 respectively. FIG. 12 shows an embodiment designated 4 of the cymbal safety arms means sleeve designated 3 demonstrated in FIGS. 1, 10 and 1. FIG. 1 shows a perspective view of the first embodiment consisting of an elongate rotatable arm means member designated 22 having an opposed off-set end portion 23 at one end and a shaft support member 24 which includes winged bolt 25 at the other end, said opposed off-set end portion 23 includes a segment 23A which is rotatably mounted or journaled within the support means member designated 10 said support means member 10 is secured to its respective primary and secondary tubular adjustable elbow mounting arm member designated 11 and 12, said elongate rotatable arm means member 22 has an opening designated 26 (FIG. 2) which passes through the interior of said elongate rotatable arm means member 22 defining an interior space sufficiently enough to accomodate for the length of the elongate shaft member designated 27 (FIG. 3 and 4) thus allowing said elongate shaft member 27 to move back and forth freely along said opening 26 to accomodate for different cymbal sizes, said shaft support member 24 is securely coupled to the exterior end of said elongate rotatable arm means member 22 adjacent to said opening 26 (FIG. 2), said shaft support member 24 and said elongate rotatable arm means member 22 have a threaded portion 24 (preferably from the bottom up) so as to allow said winged bolt 25 or similar member/means with threaded 25A exterior to be used as holding agent (threading in an upwards fashion) to firmly grip and support said elongate shaft member 27 in place (FIG. 2), said elongate shaft member 27 has a definite first end 27A (FIGS. 3,4 and 5) which is inserted— through opening 26 of said elongate rotatable arm means member 22 (FIG. 2), said elongate shaft member 27 has a (lengthwise) flat bottom portion 27B (FIGS. 4 and 5) used to firmly receive said winged bolt 25 as holding agent within said elongate rotatable arm means member 22 (FIG. 2), said elongate shaft member 27 has a definite second end or elbow support portion designated 28 with a flat top portion/a flat bottom portion and a round aperture 28A or hole in its center passing through from said flat top portion to said flat bottom portion (FIGS. 3,4 and 5), said elbow support sustains the adjustable cymbal support elbow designated 7 and its winged bolt designated 9 (FIGS. 1 and 6);

In FIG. 6 is seen an exploded view of the said adjustable cymbal support elbow 7 showing sectional and elevational views of all pertinent parts in accordance with the present invention; said adjustable cymbal support elbow 7 in exploded into two main sections 7A and 8A which are normally joined together (as meshing engagement means) by carriage bolt 7C which passes through aperture 7B and 7BX outlined on sections 7A and 8A respectively, said carriage bolt 7C contains a round head followed by a square section 7D and terminating with externally threaded portion 7E, said square section 7D will fit snugly unto square aperture 7B on said section 7A, said sections 7A and 8A fit adjustably together to selectively position cymbal 2 by carriage bolt 7C which passes through central—aperture of washer 7F and joins winged nut 7G which contains internal threaded portion 7GX which securely fastens/threads unto said externally threaded portion 7E of said carriage bolt 7C, said sections 7A and 8A contain toothed portions 7AX, which are found normally on presently used cymbal support elbows for meshing engagement to selectively position a percussion instrument to the musicians desire, said portion 7A terminates with portion 7H here showing a partial sectional view demonstrating the interior threaded portion 7HX of said portion 7H; winged bolt 9 or similar member/-means contains a threaded portion 9B which securely threads (in an upward fashion) unto said threaded portion 7HX of said portion 7H, said winged bolt 9 and said threaded portion 9B pass— through aperture in washer 9C and continues to pass through said aperture 28A of said elbow support 28 of said elongate shaft member 27 to securely fasten unto threaded portion 7HX of said section 7A so as to hold and allow said adjustable cymbal support elbow 7 to turn round freely on the said flat top portion of said elbow support 28 to a position selected by musician and thus upon tightening of said winged bolt 9 unto said portion 7H of said section 7A; said adjustable cymbal support elbow 7 will sustain a desired fixed position; said section 8A terminates in a post means such as member 8B which extends outwardly therefrom said section 8A and said member 8B is suitably dimentioned and threaded over a substantial portion of its length to accomodate and receive for reception through central apertures provided in washer 8C, a pair of resilient felt washers 8D and 8E, cymbal 2, washer 8F and a suitable securing means or holding agent like winged nut 8G which has internal threads designated 8GX; In FIG. 7 is seen a first embodiment of said elongate shaft member 27 (FIGS. 3, 4 and 5) here designated 30 having a fixed unmoveable/unadjustable post member 30C which extends outwardly therefrom said elongate shaft member 30, said elongate shaft member 30 has a definite first end 30A which is inserted into said opening 26 of said elongate rotatable arm means member 22 (FIG. 2) thus concluding in a second embodiment of the present invention, said elongate shaft member 30 has a definite second end 30B or fixed post member support portion 30B plus having an aperture illustrated by the outlines 30X whereby said fixed post member 30C intrusively forms a part thereof in a manner and union which will not come apart sustaining a rigid fixed support, said fixed post member 30C is suitably dimensioned and threaded over a substantial portion of its length to accomodate and receive for reception through outlined central apertures provided in resilient felt washers 33 and 34 and through outlined threaded central apertures provided in suitable securing means such as curling nuts 32 and 35 and locking curling nut 31 which secure a percussion instrument (cymbal) to said fixed post member 30C and as can be readily seen the cymbal may be selectively positioned relative to the length of said fixed post member 30C securing said cymbal at a desired predetermined position thus reposing it at an angle or tilt to more readily accomodate striking action by drummer; FIG. 8 shows a bottom elevational view of said elongate shaft member 30 showing members 30A, 30B, 30C, 30X described above plus said elongate shaft member 30 has a flat bottom portion 30D used to firmly receive said winged bolt 25 (as seen in FIG. 2) as holding agent within said elongate rotatable arm means 22 (FIG. 2) when said elongate shaft member 30 is inserted and positioned into said opening 26 of said elongate rotatable arm means 22 (FIG. 2) as previously described; In FIG. 9 is seen as exploded, sectional in part, elevational view of the afore-said support means member 10, the standard adjustable elbow means 11A and 12A and its primary and secondary tubular mounting arm members 11 and 12 respectively; said support means member 10 is cylindrical in shape having a central round aperture defined by space 10A having internal cylindrical wall for firmly supporting a pair of suitable bearings 10B, afore-said segment 23A is rotatably mounted and journaled within said bearings 10B and held in place by or retained by suitable ring clips 10C or other equivalent locking device concluding to the fact that afore-said elongate rotatable arm means member 22 having a said opposed off-set portion 23 is rotatable about axis A, said axis A is off-set from the longitudinal axis of said elongate arm means member 22 thus said axis A defines an axis of revolution about which said elongate rotatable arm means member 22 will continuously revolve for a given number of revolutions depending upon the force imparted by the musician; said support means member 10 can be modified to firmly hold and support (within its said internal cylindrical wall and space 10A) one, two or more said suitable bearings 10B thus varying the size, weight and employment usage of the accessory items of the present invention so that it can go —with the size and weights of cymbals to be used; said primary tubular mounting arm member 11 is directly connected to said support means member 10 forming a part thereof and/or joined by binding/securing means which will not come apart under force or pressure imparted by performance, said primary tubular mounting arm member 11 begins at the union with said support means member 10 and ends with round shaped frictionally toothed portion of elbow means member 11A, said elbow means member 11A coincides and corresponds to round shaped frictionally toothed portion of elbow means member 12A of said secondary tubular mounting arm member 12, said elbow means members 11A and 12A are normally found on presently used cymbal support elbows/cymbal stand elbows and boom cymbal stand elbows or joints (as meshing engagements) to selectively tilt and position instrument to the musicians desire, said elbow means member 11A and 12A are normally joined together by carriage bolt 5 which passes through apertures 11B and 12B on said elbow means member 11A and outlined on said elbow means member 12A respectively, said carriage bolt 5 contains a round head, followed by a square section 5A and terminating with externally threaded portion 5B; said square section 5A will fit snugly unto square aperture 11B on said elbow means member 11A, said carriage bolt 5 passes through apertures 11B and 12B thus having said threaded portion 5B pass through central aperture of washer 5C and joining winged nut 5D which contains internal threaded portion 5DX to securely fasten/threads unto said externally threaded portion 5B of said carriage bolt 5 to allow completed elbow to be functional for adjustment or tilting of instrument to desired height and angle, said elbow means member 11A can be modified for connecting said accessory to a suitable support structure so as to fit the corresponding cymbal supporting elbows on all existing commonly used cymbal stand/cymbal boom stands by sustaining and/or having corresponding bolt attachments/apertures to support employment of such a modification, said employment of tubular mounting arm member 12 can be modified to have any desired length depending on useage and/or said secondary member 12 can also connect said accessories to a suitable support structure so as to form part of an already existing cymbal stand or boom arm connected to a boom cymbal stand; In FIGS. 10 and 11 is seen an optional but necessary cymbal safety arm means sleeve 3 having a cylindrical exterior and interior walls made out of rubber/plastic or some other protective resilient elastic material to prevent cymbal from impacting against afore-said elongate rotatable arm means members, said walls define an interior space with an opening on each side designated 3A; FIG. 12 shows an embodiment 4 of said cymbal safety arm means sleeve 3 having the same facets with interior space and openings 4A but containing a slit 4B along the length of its cylindrical wall, said slit 4B will open said cylindrical wall lengthwise as a pressure is exerted upon said slit 4B when its pressed unto said elongate rotatable arm means members thus facilitating the on and off procedure as opposed to cymbal safety arm means sleeve 3 which must be slipped on to said elongate rotatable arm means members possibly prior to being journaled into said support means member 10, said cymbal safety arm means sleeves 3 and 4 are optional but highly recommended in accordance with the present invention;

In FIGS. 13 and 14 is seen the third and fourth embodiments 40 and 45 of the present invention respectively having afore-mentioned said adjustable cymbal support elbow 7 and afore-said fixed post member 30C respectively mounted on respective one-unit elongate rotatable arm means members 41 and 46 as opposed to the afore-mentioned two part said elongate rotatable arm means member 22 (FIG. 2) and corresponding said elongate shaft members 27 (FIGS. 3,4 and 5) and 30 (FIGS. 7 and 8), said elongate rotatable arm means members 41 and/or 46 is a one-unit mold having a respective elbow support portion 43 (FIG. 13) at one end sustaining all the facets for afore-said elbow support portion 28 (FIGS. 3,4 and 5) and also having a respective fixed port member support portion 48 (FIG. 14) at one end sustaining all the facets for afore-said fixed post member support portion 30B (FIGS. 7 and 8), said rotatable arm means member 41 and/or 46 have (at the other end) respective opposed off-set end portions 42 and 47, said opposed off-set end portions 42 and 47 include respective segments 42A and 47A which are rotatably mounted or journaled within afore-said support means member 10 secured to its said tubular adjustable elbow mounting arm members 11 and 12, said respective primary and secondary rotatable arm means members 41 and 46 can be modified to have varying definite desired lengths and/or manufactured in different lengths to sustain—(afterimpact) any size of cymbal in operable revolving motion, said elongate rotatable arm means members 41 and 46 having respective rotatably mounted said segments 42A and 47A are rotatable about afore-said axis A, said axis A is off-set from the longitudinal axis of said elongate rotatable arm means members 41 and/or 46 thus said axis A defines an axis of revolution about which said elongate rotatable arm means members 41 and/or 46 will continuously revolve for a given number of revolutions depending upon the force imparted by the musician, said axis A (as can be seen) is common to an approximate point in between afore-said resilient felt washers 8D and 8E and 33 and 34 where said cymbal 2 is received in reception thus said axis A lies generally parallel to and spaced from a plane defined by the marginal periphery of the cymbal, said plane's orientation may continuously vary and said axis A is always parallel thereto, said cymbal 2 and said elongate rotatable arm means members 41 and/or 46 will continuously revolve about said axis A for a given number of revolutions (depending on the force imparted by the musician) to create both novel accoustical and observational effects;

FIGS. 15 and 16 show a fifth and sixth embodiments (50 and 55 respectively) of the present invention which strikes a resemblance to a cymbal extenter which is a cymbal supporter that stacks a smaller cymbal on top of a larger one by threading onto a cymbal stand; letter X designates (for the following seven embodiments in FIGS. 15 through 21 designated 50,55,60,65,70,75 and 80 respectably) any of the afore-mentioned said elongate rotatable arm means members described in the first four embodiments of the present invention which are rotatably mounted or journaled within support means member 10 and held in place/retained by suitable ring clips 10C or other equivalent locking device, said support means members 10 (embodiment 50) (FIG. 15) is directly connected or forming a part of a primary tubular mounting arm member 50A by binding means which will not come apart under force or pressure imparted by performance, said primary tubular mounting arm member 50A is off sufficient length to permit cymbal rotation over and above another cymbal which may be supportedly mounted on a cymbal stand, said primary tubular mounting arm member 50A (FIG. 15) ends in a partial sectional view showing threaded interior 51, said threaded interior 51 can be modified to be available in metric (Japanese) or American thread so that it can thread onto existing straight, boom or telecoping boom cymbal stands thus connecting said accessories to a suitable support structure; said embodiment 55 (FIG. 16) sustains all the facets described for said embodiment 50 (FIG. 15) having respective primary and secondary tubular mounting members 55A and 55B with a suitable standard adjustable elbow member/means 56 connecting and/or joining together both said primary and secondary tubular mounting arm members 55A and 55B; said adjustable elbow member/means 56 having all the facets described for the afore-mentioned said elbow means members 11A and 12A in FIG. 9; said secondary tubular mounting arm member 55B is off sufficient length to permit cymbal rotation over and above another cymbal which may be supportedly mounted on a cymbal stand, said secondary tubular mounting arm member 55B has threaded interior 51 having same facets described for said threaded interior 51 in FIG. 15 for connecting said accessories to a suitable support structure; In FIGS. 17 through 21 is seen embodiments seven through eleven designated 60,65,70,75 and 80 respectably sustaining and supporting all the facets described and accrued to the first six embodiments of the present invention whereby 60 (FIG. 17) has respective primary, secondary and third tubular mounting arm members 61,62 and 63 whereby 62 connects said accessories to a suitable support structure via 64A and 63 thereby 61,62 and 63 are suitably attached to standard adjustable elbow means members 64 and 64A which are adjustably positioned in (functional 90 degrees) perpendicular—operable position to each other (as seen) to allow for ultimate adjustments of the said accessory item 60 when 63 of said 60 is attached to a straight, boom and/or telecoping boom cymbal stand thus also connecting said accessories to a suitable support structure or when said 60 is attached to a suitable support structure like an accessory mounting clamp or clamping means which can mount onto said stands or —existing support drum racks; said 65 (FIG. 18) has primary tubular mounting arm member 66 attached (in parallel) to said support means member 10 thus suitably attached to standard adjustable elbow means member 68 secondary and tubular mounting arm member 67 sustaining and supporting all the afore-said described accessory items facets of the present invention; said 70 (FIG. 19) shows support means member 10 with respective primary and secondary tubular mounting arm members 71 and 72 suitably meshed attached together by standard adjustable elbow means member 73 supporting all facetted descriptions of the present invention, said support means member 10 can be modified to be of any size to support and firmly hold any amounts of afore-said secondary suitable bearings 10B (FIG. 9), said tubular mounting arm member 72 is shown here attached to removable adjustable clamping adapter device/clamp 74 thus connecting said accessories to a suitable support structure, said clamping device 74 can be of any existing clamping accessory device/hardware adapter means that firmly grips tubing on straight, boom, telescoping boom stands/existing drum racks enabling the percussionist to add the present inventions accessory items wherever space is limited, said secondary tubular mounting arm member 72 can also be modified and/or manufactured to have said clamping device 74 or any suitable hardware standard clamping means forming a part thereof member 72 and/or joined by binding means which will not come apart under force or pressure imparted by performance thus connecting said accessories to a suitable support structure; said 75 (FIG. 20) shows support means member 10 with heavy duty respective primary and secondary tubular mounting arm members 76,77 secured fixed tubular mounting arm member and 78 suitably attached by standard adjustable elbow means members 76A standard adjustable tilter device means and 77A in accordance with the present invention whereby 77 connects said accessories to a suitable support structure via 77A and 78, said 75 can be modified to be the upper part of existing straight, boom/-telecoping boom cymbal stand whereby said secured fixed tubular mounting arm member 78 is suitably inserted into and axially retained and attached to the adjustable telescopic tubing on said stands thus connecting said accessories to a suitable support structure, said secured fixed tubular mounting arm member 78 can also be modified to sustain any accessory clamping device means described for 70 (FIG. 19) thus connecting said accessories to a suitable support structure; dividing arrow 78A defines an optional necessity whereby said 75 may or may not sustain counter-weight means 79 because some existing boom stands/holders and/or telescoping boom stands/holders do and do not sustain a counterweight to off-set the weight of the cymbal, thus said counterweight means 79 can be off any size, style and/or weight sufficiently enough to balance a revolving cymbal and stand; said 80 (FIG. 21) shows support means member 10 with heavy duty primary tubular mounting arm member 81 suitably attached to primary tubular mounting arm member 82 by binding means which will not come apart under force or pressure imparted by performance, said mounting arm member 81 is of semi-yoke shaped configuration sufficiently enough to allow any size of cymbal to rotate freely without impacting against said mounting arm member 81, said 82 can be modified to sustain and/or have all the afore-said supporting facets described in FIGS. 1,9 and 13 through 20 of the present invention; In FIG. 22 is seen the twelfth embodiment 90 of the present invention showing one example of a musical cymbal tree by employing a portion of the accessory items described in FIGS. 1 through 21 on a conventional cymbal stand S, said 90 (as seen) appreciates that through the use of all the embodiments and their diversifications a percussionist/manufacturer can put together a musical cymbal tree by mounting or clamping the present inventions accessory items to one another or to any conventional straight, boom/telescoping boom cymbal stands and/or existing support drum racks, percussion/drum hardware set-ups, attachments and/or any standard cymbal support means.

OPERATION OF THE INVENTION

This invention relates generally to percussion instruments' hardware such—cymbal stands, mounting arms, holders, clamps, springs, extenders, drum racks and their accessories which are now being used and adapted in the music profession. The present invention provides novel cymbal support and revolver accessory items that create unique musical sounds as well as presenting diversified animated appearances after impacting the instrument. The accessory item can come totally in the form of a fully adjustable stand (60/65/90) having one or more cymbal support revolvers or the item can he bought in the form of a compact adjustable mounting arm (20,40,45,70,75) cymbal holder revolver with clamping device (74) or an extender facetted cymbal support revolver (50/55/80). And depending on the usage of the device, it can either have an adjustable rotatable arm means member 22 comprising a shaft support member 24 with winged bolt 25 to firmly hold shaft members 27/30 or definite sized rotatable arm means members 41/46. The item/device can be equiped with either cymbal supports 7 or 30C to selectively position or tilt the cymbal's outer upper surface towards musician relative to axis A which is off-set from the longitudinal axis of said rotatable arm means members (22/41/46) and common to an appropriate point where the cymbal 2 is received in reception on said supports 7/30C. Thus axis A defines an axis of revolution about which said rotatable arm means members and cymbal will revolve for a given number of revolutions depending on the force imparted by the musician. Axis A may lie generally parallel to and spaced from a plane defined by the marginal periphery of the cymbal but because the plane's orientation can and may vary, said axis A does not need to be parallel to the marginal periphery of the cymbal to impart revolution. Cymbal support 30C will tend to sustain the parallel facet of cymbal's marginal periphery and said axis A to the longitudinal of said rotatable arm means members because of its fixed non-adjustable construction. Here the cymbal is considered a moving source by having the edge of the cymbal rotating towards and away from observers, such as an audience. The cymbal is received in between felt washers on both supports 7/30C. The cymbal must be selectively positioned relative to the length of 30C so that it can be secured at D desired predetermined position by the curling nuts. Thus, the center of gravity of the cymbal, said rotatable arm means members and support 30C will vary so that said cymbal will repose at an angle ot tilt relative to the horizontal to more readily accomodate striking. Though support 30C may consume a little time, as far as cymbal tilting, it's effective. The longitudinal of the said rotatable arm means members must be positioned perpendicular (approximately) to the arm/-striking force of musician to impart revolution with the use of cymbal support 30C, though angle adjustable elbows can vary this to some effect. But cymbal support 7 allows for greater freedon in selective cymbal tilting and the positioning of the accessory items. Its adjustability permits quick instrument tilting than support 30C by simply engaging cymbal between the felt washers, and tilting the elbow cymbal support to a desired angle (just like the elbow cymbal supports equiped on any conventional cymbal stand). Through the application and use of cymbal support 7 on any of the said rotatable arm means members, a diversified amount of directional rotation is permitted because it doesn't have to sustain the parallel facet of the cymbal's marginal periphery with said axis A and the longitudinal of said elongate rotatable arm means members. Now, not only is the cymbal considered a moving source whereby edge of cymbal rotates towards and away from observers, but depending on where impact is applied by musician and according to the angle (tilt) of cymbal with reference to the positioning of the present invention's device, the audience can now view a clockwise or counter-clockwise plus many diversified rotations giving observers an added attraction if strobelights and/or dramatic lights are used. Thus, it can be seen that through all the described said embodiments and their adjustable facets the revolver accessory items can now be positioned directly facing percussionist, or sideways, or at any angle ot tilt to the musicians desire to impart a revolution plus give viewers flashing exiting visual effects of truly unlimited epic proportions. By employing the Doppler Effect to the sound reprodution of the revolving cymbal, it can be seen that since the edges of the instrument are not necessarily in phase and the cymbal is a moving source, the pitch and intensity will rise and fall proportionately to the rate of revolution thus creating a totally unique, different, diversified and pleasing sound to the audience. If more than one cymbal is revolving at the same-time, a stupendous complex and rhythmical sound occurs along with superb visual effects. Thus, the accessory items of the present invention provide many different devices with varying shapes and forms to give a revolving cymbal effect creating both novel accoustical and observational results. Contemplating the construction of the device of the present invention, the important point to remember, as far as types of materials are concerned, is that lightness, strength is of importance for the said elongate rotatable arm means members, the said elongate shaft member, the said adjustable cymbal support elbow and said cymbal support post member along with rigid strong support for the remainder of the items construction. Therefore, steel, aluminum and/or a strong firm plastic can be used for any of the given parts of the accessory items and it should be left up to the discretion of a manufacturer.

While particular embodiments of the present invention have been shown and described, it will be obvious to those skilled in the art that other changes in form and detail and/or rami-fications may be made without departing from this invention in its broader aspects and, therefore, the aim in the appended claims is to cover all such changes and modifications as fall within the true spirit and scope of this invention.

What is claimed is:

1. A musical cymbal support and revolver accessory, the combination comprising:

an elongate rotatable arm means member of sufficient length having an exterior wall and interior wall, said walls defining a hollow interior cylindrical space and one entrance to said elongate rotatable arm means member, said space is predetermined in size and length having a beginning at said entrance and an end within said elongate rotatable arm means member, said elongate rotatable arm means member has a shaft support member exteriorly coupled at one end and adjacent to said entrance to said interior space, said elongate rotatable arm means member and said shaft support member comprise an interiorly threaded portion whereby an exteriorly threaded member threads onto thereby passing through to said interior space of said elongate rotatable arm means member, said elongate rotatable arm means member has one opposed off-set end portion at an opposite end of said entrance and said shaft support member, said opposed off-set end portion sustains a segment which is rotatably mounted and journaled within a support means member about a common axis off-set from the longitudinal axis of said elongate rotatable arm means member to define an axis of revolution about which said elongate rotatable arm means member may revolve;

an elongate shaft member of sufficient length having a first end for integral insertion and accomodation into said entrance and through said hollow interior space of said elongate rotatable arm means member, said elongate shaft member has a second end or elbow support portion, said elbow support portion is secured to said second end to comprise a flat surfaced portion consisting of a top part and a bottom part sustaining a round aperture therethrough said elbow support portion, said flat surfaced portion supports an adjustable cymbal support elbow by way of a washer and an externally threaded winged bolt or similar member/means which passes through said round aperture in an upwards fashion thereby affixing said adjustable cymbal support elbow thereto said top part of said elbow support portion of said elongate shaft member, said elongate shaft member is cylindrical in configuration but has a flat bottom portion lengthwise from said first end to said second end and beginning of said elbow support portion for securing said elongate shaft member within said interior space of said elongate rotatable arm means member, said flat bottom portion receives said winged bolt of said elongate rotatable arm means member and said shaft support member as holding agent whereby the length of said elongate shaft member may be adjusted lengthwise to a fixed position thus taking into consideration the length of said elongate rotatable arm means member so as to accomodate different sizes of cymbals;

an adjustable cymbal support elbow of sufficient size comprising a first round toothed portion having a fixed post member secured thereto and extending outwardly from said first round toothed portion, said post member is suitably dimensioned and exteriorly threaded over a substantial portion of its length to receive in reception a cymbal and securing said cymbal thereto by any provided suitable securing means received on said post member, said adjustable cymbal support elbow further comprises a second round toothed portion having an internally threaded portion extending outwardly from said second round toothed portion a, said first and said second round toothed portions are adjustably meshed and joined together as meshing engagement means by a carriage bolt, washer and a winged nut as securing adjusting means whereby said cymbal's angle of repose or tilt may be selected prior to impact for complete cymbal rotation, said adjustable cymbal support elbow further comprises a means for securing said adjustable cymbal support elbow to said flat surfaced portion of said elongated shaft member, a support means member having a cylindrically shaped core comprising an exterior wall and interior wall, said walls defining a hollow interior space with openings on both sides of said support means member, said interior space defines a central round aperture which passes from one end of said support means member to the other end of said support means member, said round aperture being parallel to said walls, said hollow interior space and said interior wall firmly hold and support one or more bearings a of any size and amounts whereby said support means member may be modified to be; said bearings rotatably mount and permit said opposed off-set end portion of said elongate rotatable arm means member to be journaled thereto within of said bearings so as to define said axis of revolution common to said opposed off-set end portion and about which said cymbal and the longitudinal of said elongate rotatable arm means member and said elongate shaft member may revolve after impact a, a primary tubular mounting arm member of sufficient length suitably connected to, said support means member said primary tubular mounting arm member may be positioned perpendicular or parallel to said support means member and the longitudinal of said elongate rotatable arm means member, said primary tubular mounting arm member comprises an adjustable elbow means forming a part thereof so as to selectively adjust the angle or tilt of said support, said adjustable elbow means further includes a secondary tubular mounting arm member for coupling said primary tubular mounting arm member with said adjustable elbow means and said secondary tubular mounting arm member function as a mounting means for connecting said accessory to a suitable support structure.

2. A musical cymbal support and revolver accessory, the combination comprising:

an elongate rotatable arm means member of sufficient length having an exterior wall and interior wall, said walls defining a hollow interior cylindrical space and one entrance to said elongate rotatable arm means member, said space is predetermined in size and length having a beginning at said entrance and an end within said elongate rotatable arm means member, said elongate rotatable arm means member has a shaft support member exteriorly coupled at one end and adjacent to said entrance to said interior space, said elongate rotatable arm means member and said shaft support member comprise an interiorly threaded portion whereby an exteriorly threaded winged bolt threads onto thereby passing through to said interior space of said elongate rotatable arm means member, said elongate rotatable arm means member includes an opposed off-set end portion at an opposite end of said entrance and said shaft support member, said opposed off-set end portion sustains a segment which is rotatably mounted within a support means member about a common axis off-set from the longitudinal axis of said elongate rotatable arm means member to define an axis of revolution about which said elongate rotatable arm means member may revolve;

an elongate shaft member of sufficient length having a first end for integral insertion and accomodation into said entrance and through said hollow interior space of said elongate rotatable arm means member, said elongate shaft member further including a second end for supporting a cymbal support fixed post member support portion, a cymbal support fixed post member support portion is secured to said second end and comprises a flat surfaced portion consisting of a top part and a bottom part sustaining a round aperture therethrough said flat surfaced portion, said cymbal support fixed post member support portion includes a cymbal support fixed post member secured into said round aperture thereby affixing said cymbal support fixed post member to said top part of said cymbal support fixed post member support portion of said elongate shaft member; said elongate shaft member is cylindrical in configuration and includes a flat bottom portion lengthwise from said first end to said second end, said flat bottom portion receives said winged bolt of said elongate rotatable arm means member a said shaft support member acts as a holding agent for said elongate shaft member whereby the length of said elongate shaft member may be adjusted lengthwise to a fixed position so as to accomodate different sizes of cymbals, said cymbal support fixed post member further comprises a fixed post member suitably dimentioned and threaded over a substantial portion of its length for receiving a cymbal and securing said cymbal thereto by a securing means received on said fixed post member;

a support means member having a cylindrically shaped core comprising an exterior wall and interior wall, said walls defining a hollow interior space with openings on both sides of said support means member, said interior space defines a central round aperture which passes from one end of said support means member to the other end of said support means member, said round aperture being parallel to said walls, said hollow interior space and said interior wall firmly hold and support one or more bearing a of; said bearings rotatably mount and permit said opposed off-set end portion of said elongate rotatable arm means member to be journaled thereto within said bearings so as to define said axis of revolution common to said opposed off-set end portion and about which said cymbal and the longitudinal of said elongate rotatable arm means member and said elongate shaft member may revolve after impact a, a primary tubular mounting arm member of sufficient length suitably connected to, said support means member; said primary tubular mounting arm member may be positioned perpendicular or parallel to said support means member and the longitudinal of said elongate rotatable arm means member, said primary tubular mounting arm member comprises an adjustable elbow means forming a part thereof so as to selectively adjust the angle or tilt of said support, said adjustable elbow means further includes a secondary tubular mounting arm member for coupling said primary tubular mounting arm member with said adjustable elbow means and said secondary tubular mounting arm member function as a mounting means to effectively for connecting said accessory to a suitable support structure.

3. A musical cymbal support and revolver accessory, the combination comprising:

an elongate rotatable arm means member of sufficient predetermined length for the accomodation of different cymbal sizes having a first end or elbow support portion, said elbow support portion is secured to said first end comprises a flat surfaced portion consisting of a top part and a bottom part sustaining a round aperture through said flat surfaced portion, said flat surfaced portion supports an adjustable cymbal support elbow comprising a washer and an externally threaded winged bolt which passes through said round aperture thereby affixing said adjustable cymbal support elbow to said top part of said elbow support portion of said elongate rotatable arm means member, said elongate rotatable arm means member includes an opposed off-set end portion at an opposite end of said first end and said elbow support portion, said opposed off-set end portion includes a segment which is rotatably mounted and journaled within a support means member about a common axis off-set from the longitudinal axis of said elongate rotatable arm means member to define an axis of revolution about which said elongate rotatable arm means member may revolve, an adjustable cymbal support elbow of sufficient size comprising a first round toothed portion having a fixed post member secured thereto and extending outwardly from said first round toothed portion, said post member is suitably dimentioned and exteriorly threaded over a substantial portion of its length to receive in reception a cymbal and securing said cymbal thereto by a securing means received on said post member, said adjustable cymbal support elbow comprises a second round toothed portion having an internally threaded portion extending outwardly therefrom said second round toothed portion whereby said adjustable cymbal support elbow may be secured to said elbow support portion of said elongate rotatable arm means member by way of said washer and said externally threaded winged bolt, said first and said second round toothed portions are adjustably meshed and joined together as meshing engagement by a securing adjusting means comprising carriage bolt, washer and a winged nut whereby said cymbal's angle of repose or tilt may be selected prior to impact, a support means member having a cylindrically shaped core comprising an exterior wall and interior wall, said walls defining a hollow interior space with openings on both sides of said support means member, said interior space defines a central round aperture which passes from one end of said support means member to the other end of said support means member, said round aperture being parallel to said walls, said hollow interior space and said interior wall firmly hold and support one or more bearing a; said bearings rotatably mount and permit said opposed off-set end portion of said elongate rotatable arm means member to be journaled thereto within said bearings so as to define said axis of revolution common to said opposed off-set end portion and about which said cymbal and the longitudinal of said elongate rotatable arm means member may revolve after impact a, a primary tubular mounting arm member of sufficient length suitably connected to, said support means member, said primary tubular mounting arm member may be positioned perpendicular or parallel to said support means member and the longitudinal of said elongate rotatable arm means member, said primary tubular mounting arm member comprises an adjustable elbow means forming a part thereof so as to selectively adjust the angle or tilt of and said support, said adjustable elbow means further includes a secondary tubular mounting arm member for coupling said primary tubular mounting arm member with said adjustable elbow means and said secondary tubular mounting arm member functions as a mounting means for connecting said accessory to a suitable support structure.

4. A musical cymbal support and revolver accessory, the combination comprising:

an elongate rotatable arm means member of sufficient predetermined length for the accomodation of different cymbal sizes comprising a first end and a cymbal support fixed post member support portion, said cymbal support fixed post member support portion is secured to said first end and comprises a flat surfaced portion consisting of a top part and a bottom part sustaining a round aperture through said flat surfaced portion said cymbal support fixed post member support portion supports a cymbal support fixed post member secured in said aperture thereby affixing said cymbal support fixed post member to said top part of said cymbal support fixed post member support portion of said elongate rotatable arm means member, said elongate rotatable arm means member further including a second end off-set and opposed to of said first end and said cymbal support fixed post member support portion, said second end portion includes a segment which is rotatably mounted and journaled within a support means member about a common axis off-set from the longitudinal axis of said elongate rotatable arm means member to define an axis of revolution about which said elongate rotatable arm means member may revolve, said cymbal support fixed post member comprising a fixed post member suitably dimentioned and threaded over a substantial portion of its length for receiving and securing a cymbal thereto, said fixed post member is fixed in the sence that it is unadjustable, said fixed post member terminates with a portion that mates with said aperture of said cymbal support fixed post member support portion of said elongate rotatable arm means member, said cymbal support fixed post member allows a cymbal to be selectively positioned at an angle or tile thereto relative to the length of said fixed post member, center of gravity of said cymbal and the longitudinal axis of said elongate rotatable arm means member whereby said cymbal's angle of repose or tilt may be selected prior to impact a, a support means member having a cylindrically shaped core comprising an exterior wall and interior wall, said walls defining a hollow interior space with openings on both sides of said support means member, said interior space defines a central round aperture which passes from one end of said support means member to the other end of said support means member, said round aperture being parallel to said walls, said hollow interior space and said interior wall firmly hold and support one, or more bearings; said bearings rotatably mount and permit said opposed off-set end portion of said elongate rotatable arm means member to be journaled thereto within of said bearings so as to define said axis of revolution common to said opposed off-set end portion and about which said cymbal and the longitudinal of said elongate rotatable arm means member may revolve after impact a, a primary tubular mounting arm member of sufficient length suitably connected to, said support means member, said primary tubular mounting arm member is positioned parallel to said support means member and perpendicular to the longitudinal axis of said elongate rotatable arm means member, said primary tubular mounting arm member further comprises a means for connecting said accessory to a suitable support structure.

5. The musical cymbal support and revolver accessory as set forth in claim 4 wherein said primary tubular mounting arm member further comprises an adjustable elbow means and a secondary tubular member;

said adjustable elbow means selectively adjusts the angle or tilt of said cymbal;

said secondary tubular mounting arm member forms a portion of said primary tubular mounting arm member at an end opposite said support means member and includes said means for connecting said accessory to a suitable support structure.

6. The musical cymbal support and revolver accessory as set forth in claim 5 wherein said means for connecting said accessory to a suitable support structure is an internally threaded means.

7. The musical cymbal support and revolver accessory as set forth in claim 4 wherein said means for connecting said accessory to a suitable support structure is an internally threaded means.

8. The musical cymbal support and revolver accessory as set forth in any one of claims 1, 2, 3, or 4 wherein said primary tubular mounting arm member has a semi-yoke shaped configuration.

* * * * *